US006109357A

United States Patent [19]

Zimmerman

[11] Patent Number: 6,109,357

[45] Date of Patent: Aug. 29, 2000

[54] CONTROL LINE ACTUATION OF MULTIPLE DOWNHOLE COMPONENTS

[75] Inventor: Patrick J. Zimmerman, Houston, Tex.

[73] Assignee: Baker Hughes Incorporated, Houston, Tex.

[21] Appl. No.: 08/989,948

[22] Filed: Dec. 12, 1997

[51] Int. Cl.[7] ..... E21B 33/128

[52] U.S. Cl. ..... 166/387; 166/72; 166/188

[58] Field of Search ..... 166/387, 188, 166/321, 319, 320, 324, 332, 72

[56] References Cited

U.S. PATENT DOCUMENTS

| | | |
|---|---|---|
| 4,074,692 | 2/1978 | Shafer . |
| 4,119,146 | 10/1978 | Taylor . |
| 4,135,547 | 1/1979 | Akkerman et al. . |
| 4,149,698 | 4/1979 | Deaton . |
| 4,173,256 | 11/1979 | Kilgore . |
| 4,234,043 | 11/1980 | Roberts . |
| 4,252,197 | 2/1981 | Pringle . |
| 4,325,409 | 4/1982 | Roberts . |
| 4,373,587 | 2/1983 | Pringle . |
| 4,423,782 | 1/1984 | Bowyer . |
| 4,431,051 | 2/1984 | Adams, Jr. . |
| 4,432,417 | 2/1984 | Bowyer . |
| 4,448,254 | 5/1984 | Barrington . |
| 4,467,867 | 8/1984 | Baker . |
| 4,560,004 | 12/1985 | Winslow et al. . |
| 4,569,398 | 2/1986 | Pringle . |
| 4,636,934 | 1/1987 | Schwendemann et al. . |
| 4,660,646 | 4/1987 | Blizzard . |
| 4,664,196 | 5/1987 | Manke . |
| 4,676,307 | 6/1987 | Pringle . |
| 5,101,904 | 4/1992 | Gilbert . |
| 5,184,677 | 2/1993 | Dobscha et al. . |
| 5,209,303 | 5/1993 | Barrington . |
| 5,226,485 | 7/1993 | Dobscha et al. . |
| 5,244,004 | 9/1993 | Robertson . |
| 5,251,702 | 10/1993 | Vazquez . |
| 5,314,026 | 5/1994 | Williamson, Jr. . |
| 5,415,237 | 5/1995 | Strattan . |
| 5,564,501 | 10/1996 | Strattan et al. . |

FOREIGN PATENT DOCUMENTS

| | | |
|---|---|---|
| 2704754 | 8/1978 | Germany . |
| 1577828 | 10/1980 | United Kingdom . |
| 2163793 | 3/1986 | United Kingdom . |
| 2183695 | 6/1987 | United Kingdom . |
| 2 285 463 | 7/1995 | United Kingdom . |
| WO 98/09055 | 3/1998 | WIPO . |

OTHER PUBLICATIONS

Baker Oil Tools, catalogue information on Retrievable Packer Systems, 2 pages, date unknown.

Baker Oil Tools, information on Model "CMP" Pump–Open Sliding Sleeve, 2 pages, date unknown.

*Primary Examiner*—Frank S. Tsay

*Attorney, Agent, or Firm*—Duane, Morris & Heckscher LLP

[57] ABSTRACT

One or more downhole tools can be set using an apparatus and method where a control line runs outside a tubular string. The string and downhole tools do not have lateral penetrations and the downhole tool(s) are actuated externally from the control line which is in the annular space.

20 Claims, 6 Drawing Sheets

CONTROL LINE ACTUATION OF MULTIPLE DOWNHOLE COMPONENTS

FIELD OF THE INVENTION

The field of this invention relates to use of control lines running in tandem with tubing downhole for operation of a variety of downhole components.

BACKGROUND OF THE INVENTION

Downhole components such as packers are frequently set by obstruction of the tubing with a ball dropped to a seat, followed by a pressure buildup through a lateral port to hydraulically actuate the slips and sealing elements of the packer. One example of such a packer is the FH Retrievable Packer offered by Baker Oil Tools. This type of packer and others like it have a port through the mandrel of the packer to provide access for the hydraulically actuated mechanisms which set the slips and the packing elements and lock the set position of the packer. The opening in the tubing wall through the packer is a disadvantage because it is a potential leak path.

Packers having this potential leak path have also been combined with a control line which runs completely through the packer mandrel for connection to another tool below the packer, such as, for example, a sliding sleeve valve which is hydraulically operated. One such sliding sleeve valve is available from Baker Oil Tools as the CM design. In these installations, the setting of the packer occurs by obstruction of the tubular, followed by a pressure buildup through the lateral opening in the tubular, through the packer. The operation of the equipment below the packer is independent, through the control line, which runs through the body of the packer.

It is thus an objective of the present invention to eliminate the opening in the tubular wall through the packer. Additionally, it is another objective of the present invention to employ the existence of a control line for not only operation of downhole equipment below the packer, but also for setting and/or releasing of the packer. It is a further objective of the invention to employ a control line to operate one or more discrete downhole hydraulically actuated devices so as to ensure the integrity of the tubing string, which in turn would have no lateral openings and comprise of premium joints over its length. These and other objectives can be better understood by a review of the description of the preferred embodiment below.

SUMMARY OF THE INVENTION

An apparatus and method is disclosed which permits operation of multiple downhole tools using at least one control line running outside the tubular string. The control line can be used to set and release a packer as well as one or more components mounted adjacent to the packer, which depend on hydraulic pressure for their operation.

DETAILED DESCRIPTION OF THE DRAWINGS

Figure 1A:
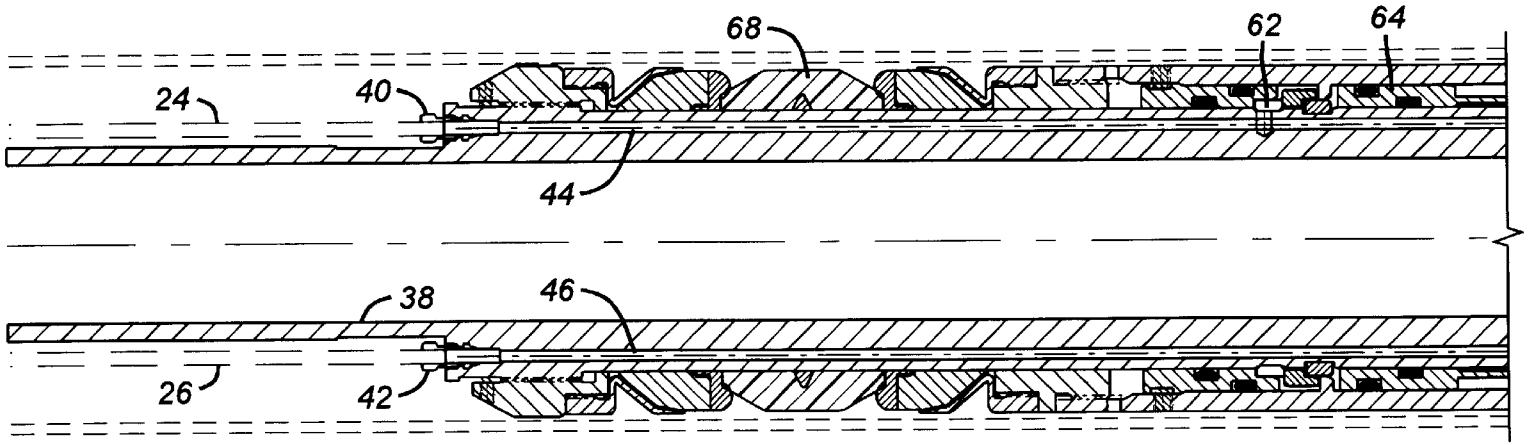
Figure 2A:
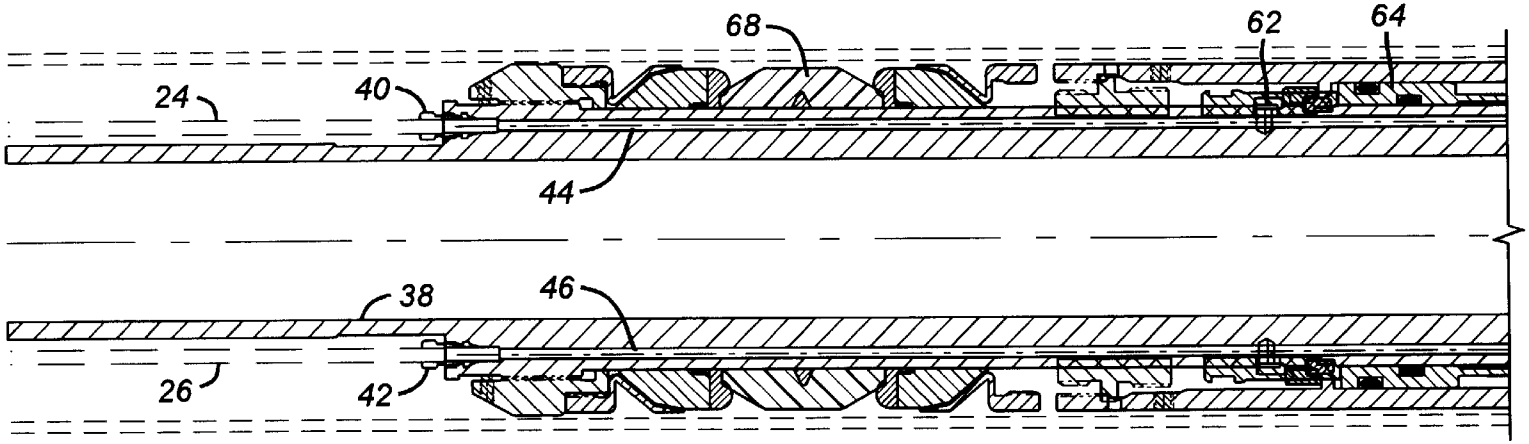
Figure 1B:
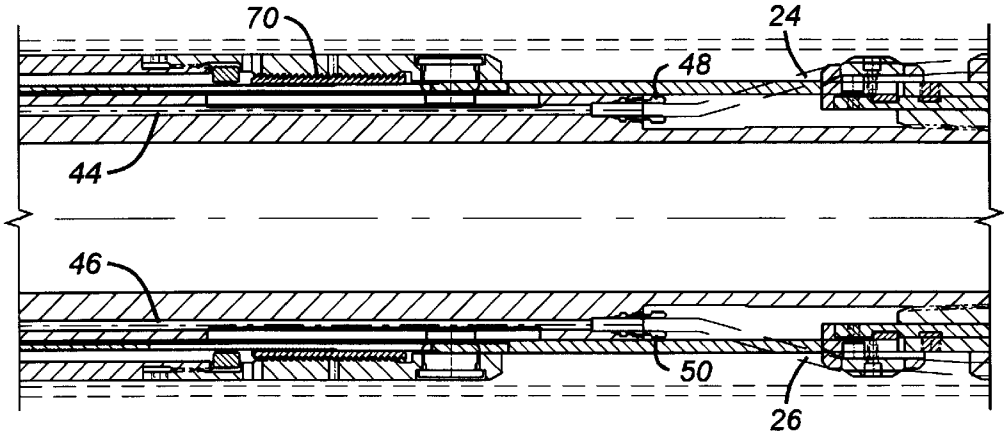
Figure 2B:
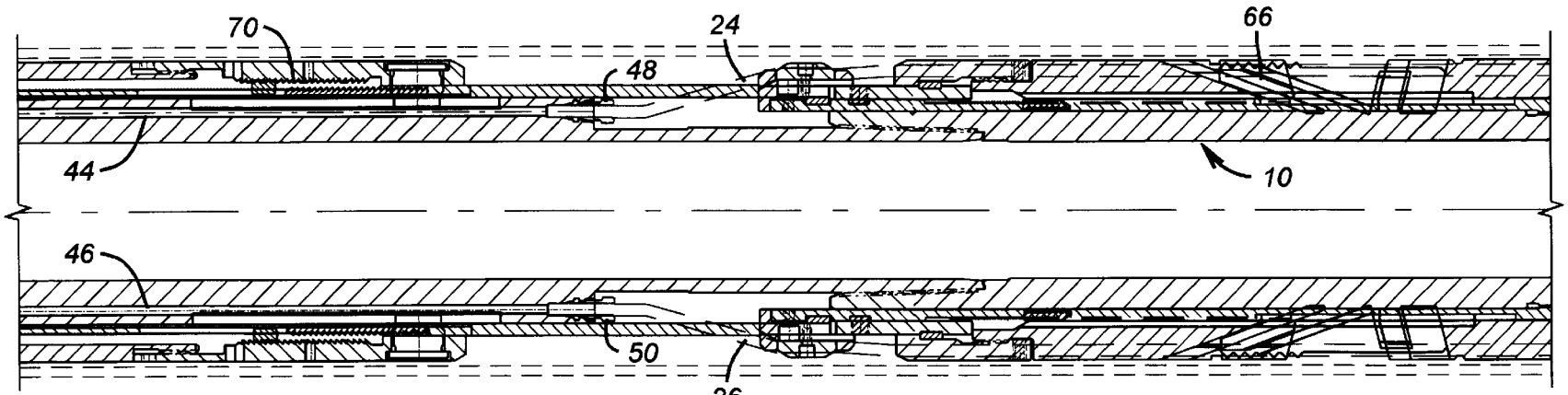
Figure 1C:
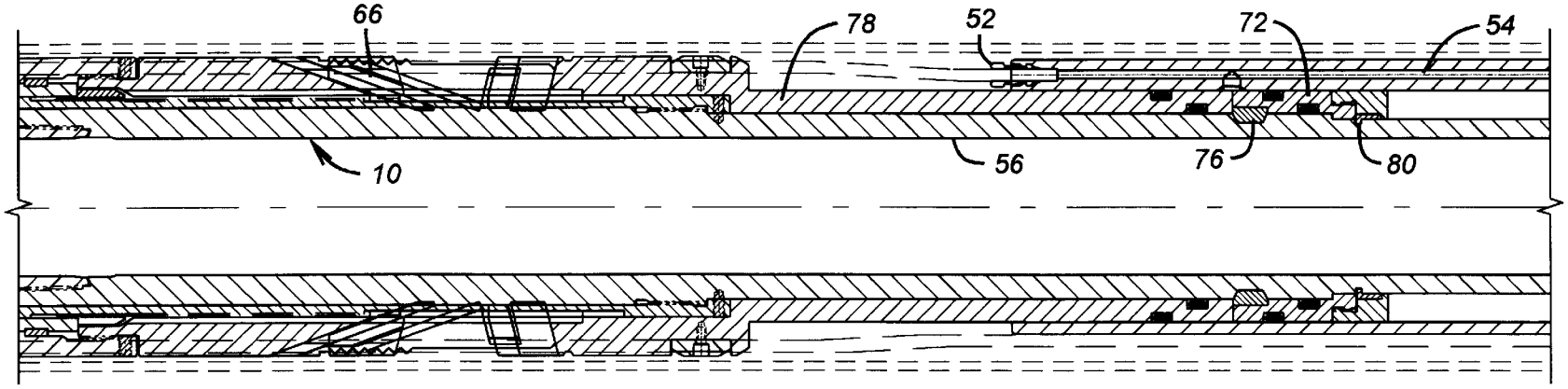
Figure 2C:
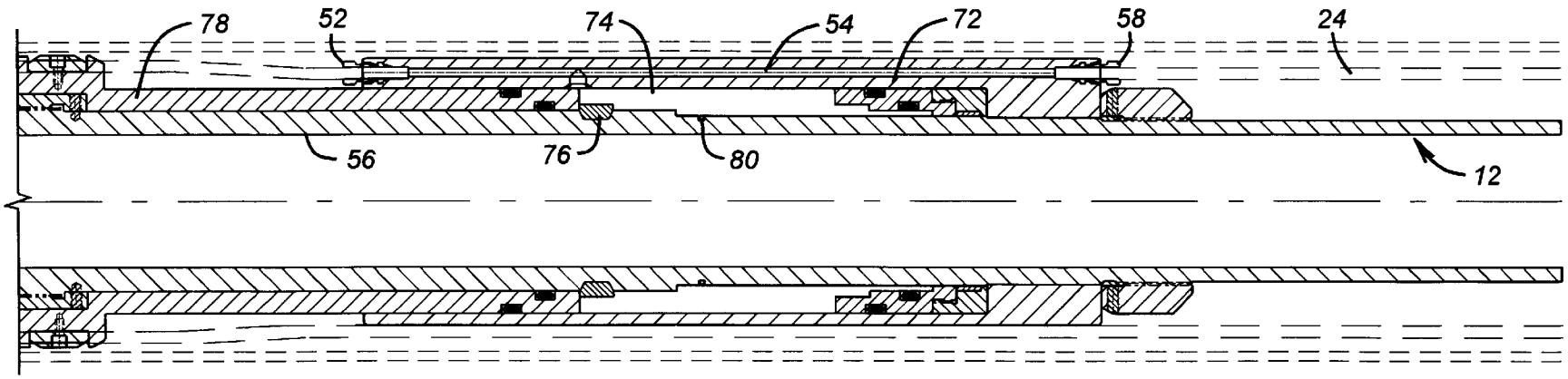

FIGS. 1*a–f* are a cross sectional, elevational view showing application of the apparatus of the present invention and operation of the packer and a shifting sleeve valve below in the run in position; and FIGS. 2*a–c* illustrate the packer in sectional, elevational view as seen in FIGS. 1*a–c*, except that the release mechanism for the packer has been actuated.

DETAILED DESCRIPTION OF THE PREFERRED EMBODIMENT

Figure 1D:
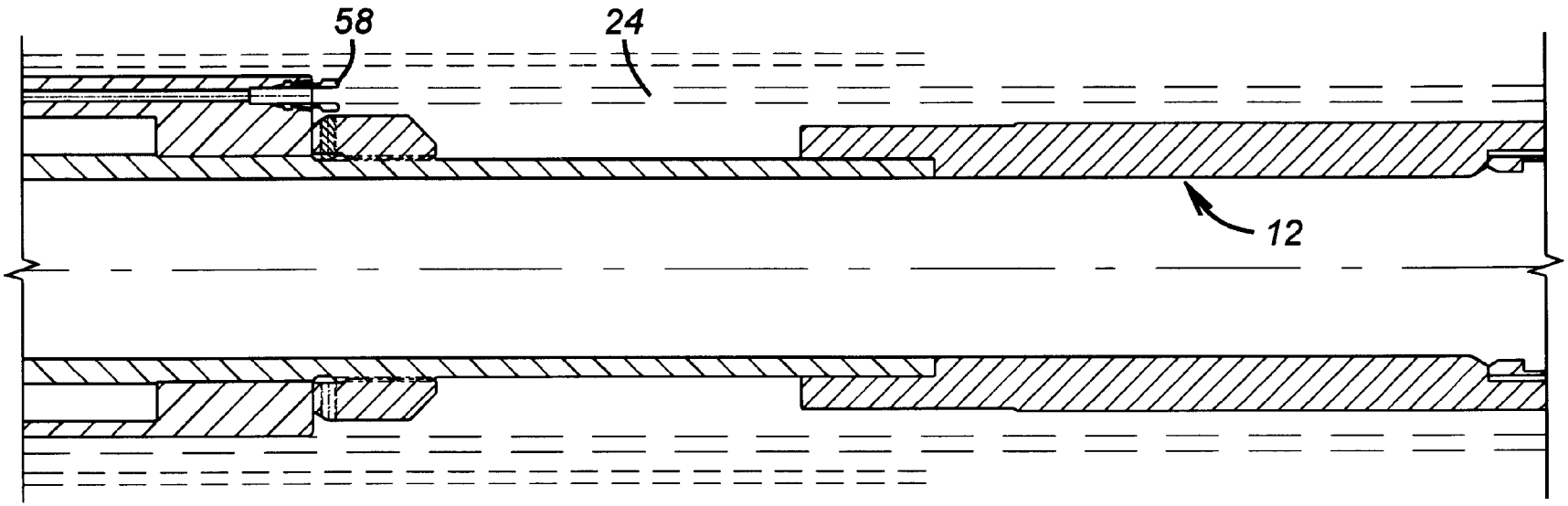
Figure 1E:
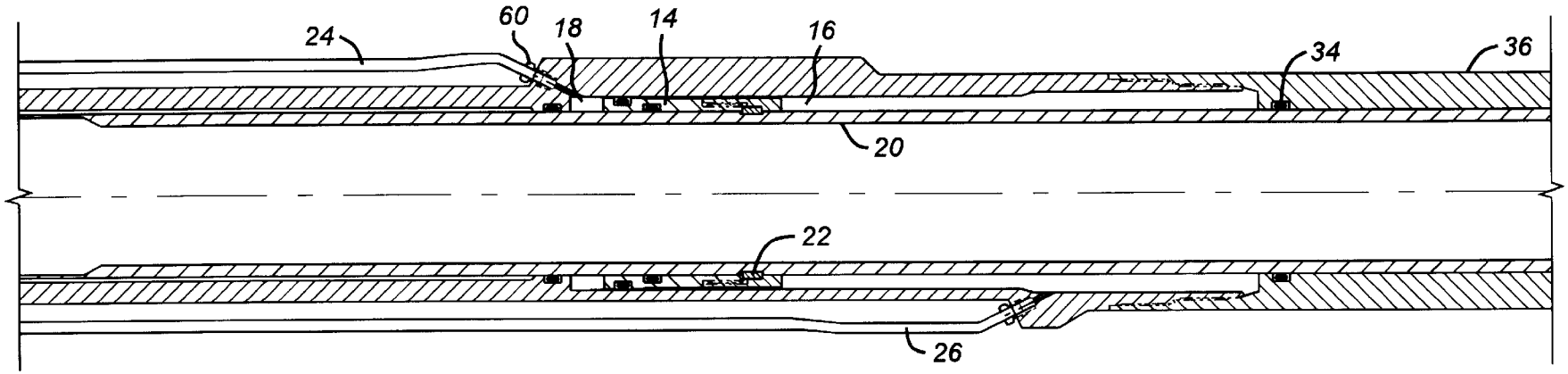
Figure 1F:
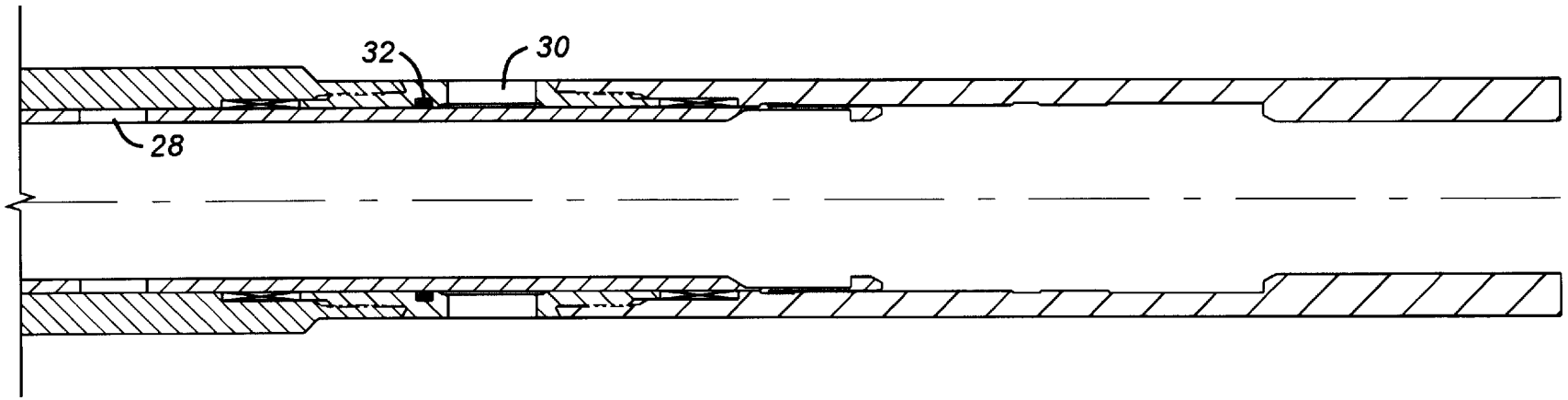

As shown in FIGS. 1*a–d*, a packer 10 is connected to a sliding sleeve valve 12, which is shown in FIGS. 1*d–f*. The particular embodiment of the sliding sleeve valve 12 operates on movement of a piston 14 responsive to hydraulic pressure applied in chambers 16 and 18. The piston 14 is connected to a sliding sleeve 20 via a ring 22. Control lines 24 and 26 are connected, respectively, to chambers 18, and 16. Sleeve 20 has a port 28 which, in the position shown in FIG. 1*f*, is isolated from port 30 by seal 32. Seal 34 seals between sleeve 20 and body 36. Thus, when pressure is increased in chamber 18, the piston 14 takes with it sleeve 20 and moves downhole, bringing port 28 into alignment with port 30 to open the valve. The control lines 24 and 26 extend to the surface, although they are truncated in FIG. 1*a*. Control lines 24 and 26 run outside of the tubing string (not shown), which ultimately connects to the mandrel 38 of the packer 10. As seen in FIG. 1*a*, the control lines 24 and 26 are connected via fittings 40 and 42, respectively, to passages 44 and 46, respectively, which extend through mandrel 38. At the other end of passages 44 and 46, fittings 48 and 50 again connect control lines 24 and 26. Fitting 52 is used to connect control line 24 to a passage 54 and lower mandrel 56. Fitting 58 connects control line 24 to passage 54 and at the other end fitting 60 connects control line 24 to chamber 18.

The packer 10 has no lateral openings through the mandrel 38 or the lower mandrel 56. Instead, passage 44 is in fluid communication with chamber 62, which is in turn exposed to piston 64 which creates the necessary relative movement to set the slips 66 and the sealing element 68. Upon extending the slip 66 and the sealing element 68 into sealing contact with the tubing or casing in the wellbore (not shown), the set position is held by lock ring 70 in a known manner. Packer 10 is released by extension, which is accomplished when the mandrel 38 and lower mandrel 56 are liberated for a pickup force when piston 72, shown in FIG. 1*c*, moves to the position shown in FIG. 2c as a result of pressure applied in passage 54 which communicates with cavity 74 and is best seen in FIG. 2*c*. When the piston 72 shifts as shown in FIGS. 1*c* and 2*c*, the dogs 76 become unsupported, thus allowing relative movement between mandrel 38, lower mandrel 56 and sleeve 78. In order to move piston 72, the L-shaped ring 80 needs to be broken by movement of piston 72 before the dogs 76 can be liberated.

While an embodiment as illustrated in FIGS. 1*a–f* and 2*a–c* is shown with two control lines 24 and 26, the scope of the preferred invention is a single control line. For example, if the downhole tool below the packer 10 was one that could operate on a single pressure source, then a single control line such as 24 would suffice. One example is the subsurface safety valve control system illustrated in U.S. Pat. No. 5,415,237. Additionally, a single control line can also be extended beyond chamber 18, shown in FIG. 1 e, downhole to yet one or more other down-hole devices for operation thereof.

Those skilled in the art can see that what is shown in the figures is a packer 10 with no lateral openings through its mandrel 38 and lower mandrel 56. Instead, the control line 24 through access to chamber 62 can be used to build pressure to create the relative movement necessary to set the packer 10 in a known manner. Thus, for example, pressure of about 3000 pounds can be used to set the packer 10. Application pressure in control line 24 may temporarily open the sliding sleeve valve 12 as pressure is increased in chamber 18. However, the temporary movement of the sliding sleeve valve 12 is immaterial because as soon as the packer 10 is set and the lock ring 70 holds the position, the pressure can be bled off control line 24 and increased in control line 26 to reposition the sliding sleeve valve 12 back to the closed position, as shown in FIG. 1*f*. The same control line 24, through its communication with cavity 74, can also be used to unlock the packer for release by a pickup force of the mandrel 38. The release pressure is generally fairly high, in the order of 6,000 psi, and is significantly more than the pressure required to operate the tools below the packer 10 after the packer 10 has been set. Once the packer 10 is set and locked at lock ring 70, a fairly low pressure on the order of about 1,000 pounds, for example, in control line 24 can be used to actuate the valve 12 into the open position. As long as the pressure doesn't exceed the shear rating of the angle ring 80, the packer 10 will not inadvertently release. Within the operating environment of zero to 6,000 pounds, which will release the packer, the pressure in the control line can be varied to operate one or more different downhole devices. These devices can be operated by a common line and have different pressures for their own actuations or, alternatively, separate control lines can be run such as 26 for operation of a single or multiple other downhole devices.

Those skilled in the art can appreciate that the use of a control line to set the packer eliminates a leak path through the mandrel 38 of the packer. Thus, the integrity of the string is maintained because the only potential leak paths are the premium joints at the end of each segment of tubing. Thus failures in the various O-rings in the packer structure do not compromise the integrity of tubing string. Additionally, with the hydraulic release feature, as described above, a separate trip in the hole to grab hold of a release ring and break a shear pin so as to liberate collets and thereby allow the packer to be stretched out in a known manner, is also eliminated. However, it is also within the scope of the invention to use the mechanical release technique of a ring held with shear pins to hold collets in place, in combination with a control line setting of the packer. The nature and amount of the downhole tools employing this technique can be varied without departing from the spirit of the invention. In the preferred embodiment, a packer is combined with at lease one other tool, wherein both are operated from at least one control line so as not to jeopardize the integrity of the tubing string from the surface.

The foregoing disclosure and description of the invention are illustrative and explanatory thereof, and various changes in the size, shape and materials, as well as in the details of the illustrated construction, may be made without departing from the spirit of the invention.

What is claimed:

1. A method of operating at least one downhole tool, comprising:

running in at least a first and second pressure-actuated downhole tools on a tubing string;

using a packer as said first downhole tool;

running at least one control line outside said tubing string; and activating at least one of said packer and said second downhole tool from outside said tubing string using said control line.

2. The method of claim 1, further comprising:

obstructing an annular space around the tubing string with said packer.

3. The apparatus of claim 2, further comprising:

setting the packer by pressure delivered through said control line.

4. A method of operating at least one downhole tool, comprising:

running in at least a first and second pressure-actuated downhole tools on a tubing string;

running at least one control line outside said tubing string;

activating said first and second downhole tools using said control line;

using a packer as said first downhole tool;

obstructing an annular space around the tubing string with said first downhole tool;

setting the packer by pressure delivered through said control line; and releasing the packer by pressure delivered through said control line.

5. The apparatus of claim 1, further comprising:

actuating said first downhole tool to a set position followed by actuation of said second downhole tool.

6. A method of operating at least one downhole tool, comprising:

running in at least a first and second pressure-actuated downhole tools on a tubing string;

running at least one control line outside said tubing string;

activating said first and second downhole tools using said control line;

actuating said first downhole tool to a set position followed by actuation of said second downhole tool;

using a packer as said first downhole tool;

locking the packer in a set position using said control line;

varying the control line pressure thereafter to operate said second downhole tool.

7. The method of claim 6, further comprising:

operating said second downhole tool within a pressure range in said control line below which will release said packer.

8. The method of claim 7, further comprising:

increasing control line pressure to release the packer.

9. The method of claim 8, further comprising:

using a pressure-operated valve as said second downhole tool.

10. The method of claim 9, further comprising:

using a sliding sleeve valve as said pressure-operated valve.

11. The method of claim 10, further comprising:

providing a packer mandrel as a portion of said tubing string; and providing no wall penetrations in said mandrel or tubing string down to said packer which could form potential leak paths to an annular space around said tubing string.

12. The method of claim 6, further comprising:

providing a packer mandrel as a portion of said tubing string; and providing no wall penetrations in said mandrel or tubing string down to said packer which could form potential leak paths to an annular space around said tubing string.

13. A method of operating a pressure-set packer and at least one other downhole tool, comprising:

running a packer and at least one other downhole tool into a well on tubing;

running in at least one control line adjacent to said tubing to said packer and downhole tool; and setting said packer and operating said downhole tool through said control line from outside of said tubing.

14. The method of claim 13, further comprising:

providing no lateral penetrations in said tubing down from the surface through said packer and to said downhole tool which could be potential leak paths to an annular space around said tubing.

15. A method of operating a pressure-set packer and at least one other downhole tool, comprising:

running a packer and at least one other downhole tool into a well on tubing;

running in at least one control line adjacent to said tubing to said packer and downhole tool;

setting said packer and operating said downhole tool through said control line;

providing no lateral penetrations in said tubing down from the surface through said packer and to said downhole tool which could be potential leak paths to an annular space around said tubing;

locking said packer in a set position; and manipulating said downhole tool with said control line while said packer is set.

16. The method of claim 15, further comprising:

using a range of pressures in said control line to operate said downhole tool with the packer set; and exceeding said range of pressure to release the packer.

17. The method of claim 16, further comprising:

communicating said control line through at least one longitudinal passage in the mandrel of said packer;

communicating said mandrel passage with a set and release piston for selective set and release of said packer;

extending said control line beyond said packer to at least one passage in said downhole tool;

operating a piston in said downhole tool through said passage thereon; and activating said downhole tool with said piston thereon.

18. The method of claim 17, further comprising:

operating a plurality of downhole tools with said control line after setting said packer.

19. A method of operating a packer downhole, comprising:

running in a hydraulically set packer on tubing;

running in at least one control line on said tubing; and operating the packer with pressure applied through said control line outside said tubing.

20. A method of operating a packer downhole, comprising:

running in a hydraulically set packer on tubing;

running in at least one control line on said tubing;

operating the packer with pressure applied through said control line outside said tubing; and setting and releasing said packer from said control line.

* * * * *